US005880073A

United States Patent [19]

Tomizawa et al.

[11] Patent Number: 5,880,073

[45] Date of Patent: Mar. 9, 1999

[54] LUBRICATING OIL COMPOSITION

[75] Inventors: Hirotaka Tomizawa; Arai Katsuya, both of Saitama-ken, Japan

[73] Assignee: Tonen Corporation, Saitama, Japan

[21] Appl. No.: 945,703

[22] PCT Filed: May 24, 1995

[86] PCT No.: PCT/US95/05142

§ 371 Date: Feb. 6, 1998

§ 102(e) Date: Feb. 6, 1998

[87] PCT Pub. No.: WO96/37583

PCT Pub. Date: Nov. 28, 1996

[51] Int. Cl.[6] ..... C10M 139/06; C10M 135/14

[52] U.S. Cl. ..... 508/383; 508/382; 508/444; 508/563

[58] Field of Search ..... 508/364, 365, 508/382, 383, 370, 563

[56] References Cited

U.S. PATENT DOCUMENTS

| | | | |
|---|---|---|---|
| 3,356,702 | 12/1967 | Farmer et al. | 508/363 |
| 3,696,851 | 10/1972 | Randell | 508/563 |
| 3,840,463 | 10/1974 | Froeschmann et al. | 508/365 |
| 3,944,492 | 3/1976 | Wheeler | 508/563 |
| 4,259,254 | 3/1981 | Bridger | 508/363 |
| 4,370,246 | 1/1983 | DeVries et al. | 508/226 |
| 4,789,492 | 12/1988 | Katsumata et al. | 508/379 |
| 4,812,246 | 3/1989 | Yabe | 508/364 |
| 4,832,867 | 5/1989 | Seiki et al. | 508/364 |
| 5,186,852 | 2/1993 | Ishida et al. | 508/563 |
| 5,605,880 | 2/1997 | Arai et al. | 508/379 |
| 5,650,381 | 7/1997 | Gatto et al. | 508/364 |
| 5,658,866 | 8/1997 | Yoshida et al. | 508/503 |

FOREIGN PATENT DOCUMENTS

WO94/25549 11/1994 WIPO .

*Primary Examiner*—Ellen M. McAvoy
*Attorney, Agent, or Firm*—Joseph J. Allocca

[57] ABSTRACT

A lubricating oil composition comprising (A) a base oil containing 3% by weight or less of aromatics, 20% by weight or more of monocyclic naphthenes, 50 ppm by weight or less of N and 50 ppm by weight or less of S, having a viscosity (100° C.) of 2 to 50 $mm^2/s$, (B) alkyldiphenylamines and/or phenyl-alpha-naphthylamines in an amount of 0.05 to 2% by weight of the total weight of the composition, and (C) $C_8$–$C_{23}$ MoDTC and/or $C_8$–$C_{18}$ MoDTP and/or $C_8$–$C_{18}$ MoDTX in such an amount that the amount of Mo is 50 to 2000 ppm by weight of the total weight of the composition. The lubricating oil composition has high heat resistance, high oxidation stability and excellent lubricating properties, and is particularly useful for a lubricating oil for internal combustion engines and the like.

3 Claims, 1 Drawing Sheet

LUBRICATING OIL COMPOSITION

BACKGROUND OF THE INVENTION

1. Field of the Invention

The present invention relates to a novel lubricating oil composition, and more specifically to a lubricating oil composition having high heat resistance, high oxidation stability and excellent lubricating properties, useful as a lubricating oil for internal-combustion engines, automatic transmission gearboxes, dampers, power steering units and the like, particularly useful as a lubricating oil for internal combustion engines.

2. Description of the Related Art

Lubricating oils have been used for internal combustion engines, and for driving units and gears such as automatic transmission gearboxes, dampers and power steering unit in order to smoothly operate them. In particular, lubricating oils for internal-combustion engines (engine oils) not only lubricate various sliding portions such as a piston ring, a cylinder liner, bearings for a crank shaft and a connecting rod, and a valve-operating mechanism including a cam and a valve lifter, but also cool the inside of the engines, clean and disperse those products which are produced by combustion, and prevent the rusting and corrosion of the engines.

Thus, the lubricating oils for internal-combustion engines have been required to have a great variety of properties. Moreover, due to the recent trend toward high-performance, high-output internal-combustion engines and more severe operating conditions, the lubricating oils are required to have higher quality. In order to meet this requirement, various additives such as an antiwear agent, a metallic detergent, a nonash dispersant and an antioxidant are incorporated into the lubricating oils for internal-combustion engines.

It is particularly important as the essential function of the lubricating oils for internal-combustion engines that the lubricating oils can ensure the smooth operation of the engines under every condition to prevent the wear and seizure of the engines. The parts of the engines to be lubricated are, in most cases, under the fluid lubrication condition. However, the valve train, and the top and bottom dead centers of a piston tend to be under the boundary lubrication condition. Antiwear properties under the boundary lubrication condition are generally imparted by the addition of zinc dithiophosphate (ZnDTP) or zinc dithiocarbamate (ZnDTC).

Energy loss at the friction parts of internal-combustion engines which are lubricated by lubricating oils is great. For this reason, a lubricating oil to which various additives including a friction modifier (FM) are added has been used in order to reduce the friction loss and to decrease the fuel cost (e.g., Japanese Laid-Open Patent Publication No. 23595/1991). Lubricating oils for automotive internal-combustion engines are used at various temperatures, at various revolutions per minute and under various loads. Therefore, in order to further improve the rate of fuel consumption, it is necessary that the lubricating oils be excellent in friction properties under a wide range of conditions under which they are used.

Besides the above-described properties, high heat resistance, high oxidation stability and moderate viscosity characteristics can be mentioned as the properties required for the lubricating oils for internal-combustion engines.

The present invention is directed to meeting these requirements. An object of the present invention is therefore to provide a lubricating oil composition having excellent lubricating properties, high heat resistance, high oxidation stability and moderate viscosity characteristics, particularly useful as a lubricating oil for internal-combustion engines.

SUMMARY OF THE INVENTION

Figure 1:
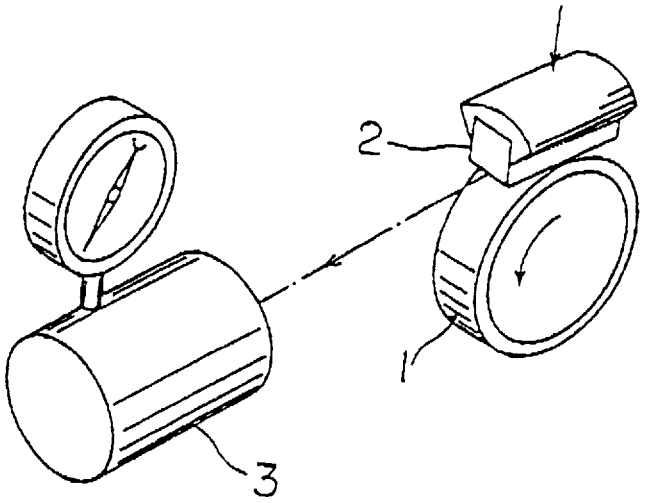
FIG. 1 is a diagrammatic view of an apparatus used in the LFW-1 friction test in which 1 is the S-test ring, 2 is the R-type block, and 3 is a distortion meter.

After intensive investigations made for the purpose of developing a lubricating oil composition having the above-described advantageous properties, it has been discovered that the object can be attained by a composition which is obtainable by adding a predetermined amount of a specific amine antioxidant, and a predetermined amount of oxymolybdenum sulfide dithiocarbamates (MoDTC), oxymolybdenum sulfide organophosphorodithioates (MoDTP) or oxymolybdenum sulfide dithioxanthogenates (MoDTX to a lubricating base oil containing a small amount of aromatics, and having other specific characteristics. The present invention has been accomplished on the basis of the above finding.

Namely, the present invention relates to:

(1) a lubricating oil composition characterized by comprising:

(A) a lubricating base oil containing 3% by weight or less of aromatics, 20% by weight or more of monocyclic naphthenes, 50 ppm by weight or less of sulfur and 50 ppm by weight or less of nitrogen, having a viscosity of 2 to 50 $mm^2/s$ at 100° C.;

(B) at least one compound selected from diarylamines of the general formula:

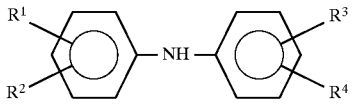

[1]

wherein $R^1$, $R^2$, $R^3$ and $R^4$, which may be the same or different, each represent hydrogen atom or a hydrocarbon group having 3 to 18 carbon atoms, provided that at least one of them is the hydrocarbon group, or of the general formula:

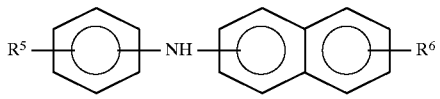

[2]

wherein $R^5$ and $R^6$ are hydrogen atom or a hydrocarbon group having 1 to 18 carbon atoms, in an amount of 0.05 to 3% by weight of the total weight of the composition; and (C) at least one compound selected from oxymolybdenum sulfide dithiocarbamates of the general formula:

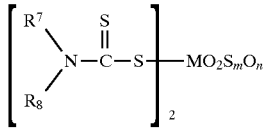

[3]

wherein $R^7$ and $R^8$, which may be the same or different, each represent a hydrocarbon group having 5 to 23 carbon atoms, and m and n are a positive integer, provided that the total number of m and n is 4, oxymolybdenum sulfide organophosphorodithioates of the general formula:

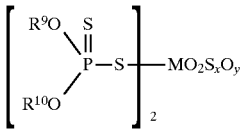

[4]

wherein $R^9$ and $R^{10}$, which may be the same or different, each represent a hydrocarbon group having 1 to 18 carbon atoms, and x and y are a positive integer, provided that the total number of x and y is 4, and oxymolybdenum sulfide dithioxanthogenates of the general formula:

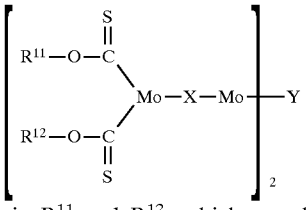

[5]

wherein $R^{11}$ and $R^{12}$, which may be the same or different, each represent a hydrocarbon group having 1 to 30 carbon atoms, and X and Y, which may be the same or different, each represent oxygen or sulfur atom, in such an amount that the amount of molybdenum is 50 to 2000 ppm by weight of the total weight of the composition.

Further, preferred embodiments of the present invention are as follows:

(2) the lubricating oil composition as set forth in the above item (1), wherein the lubricating base oil is a hydrogenated oil containing 3% by weight or less of aromatics, 20% by weight or more of monocyclic naphthenes, and 97% by weight or more of saturated compounds;

(3) the lubricating oil composition as set forth in the item (1) or (2), wherein the lubricating base oil is a hydrogenated oil, the diarylamines are alkyldiphenylamines containing at least one alkyl group having 3 to 18 carbon atoms or phenyl-α-naphthylamines containing an alkyl group having 3 to 18 carbon atoms, and containing the oxymolybdenum sulfide dithiocarbamate;

(4) the lubricating oil composition as set forth in the item (1), (2) or (3), containing the oxymolybdenum sulfide organophosphorodithioates, having an alkyl group having 8 to 18 carbon atoms;

(5) the lubricating oil composition as set forth in the item (1), (2), (3) or (4), containing the oxymolybdenum sulfide dithioxanthogenates, having an alkyl group having 8 to 18 carbon atoms; and (6) a method for reducing fuel consumption by the use of the lubricating oil composition described above in internal-combustion engines.

DETAILED DESCRIPTION OF THE INVENTION

In the lubricating oil composition of the present invention, an oil containing 3% by weight or less of aromatics, 20% by weight or more of monocyclic naphthenes, 50 ppm by weight or less of sulfur and 50 ppm by weight or less of sulfur and 50 ppm by weight or less of nitrogen, having a viscosity of 2 to 50 $mm^2/s$ at 100° C. is used as the lubricating base oil, the component (A). The preferable amount of the monocyclic naphthenes is in the range of 25 to 40% by weight. When the amount of the aromatics exceeds 3% by weight, the resulting lubricating oil composition undergoes deterioration in heat resistance, oxidation stability and lubricating properties. In the case where the amount of the monocyclic naphthenes is less than 20% by weight, the resulting composition cannot have sufficiently high adaptability to sealing rubber. Further, when the lubricating base oil has a viscosity of lower than 2 $mm^2/s$, the resulting composition is poor in the oil-film-forming properties, and has a shortcoming in that it undergoes a great evaporation loss. A base oil having a viscosity of higher than 50 $mm^2/s$ is also unfavorable because the power loss of the resulting composition caused by viscosity resistance is too great. Furthermore, when either sulfur or nitrogen content exceeds 50 ppm by weight, the oxidation stability and lubricating properties of the resulting composition become poor.

Either mineral or synthetic oil can be used as the lubricating base oil as long as it has the aforementioned properties. Specific examples of the base oil include raffinates which can be obtained by subjecting starting materials for lubricating oils derived from naphthene base or paraffin base crude oil by evaporation under normal or reduced pressure to solvent refining, using an aromatic extraction solvent such as phenol, furfural or N-methylpyrrolidone, and hydrogenated oils which can be obtained by subjecting starting materials for lubricating oils to hydrogenation treatment including hydrocracking reaction. In either production process, such processes as dewaxing, hydrorefining and clay treatment processes may be optionally adopted in accordance with the conventional manner. Particularly preferable base oils are hydrocracked oils and wax-isomerized oils.

In the composition of the present invention, at least one compound selected from diarylamines of the general formula [1]:

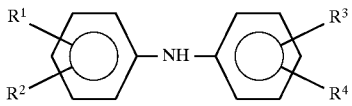

[1]

or of the general formula [2]:

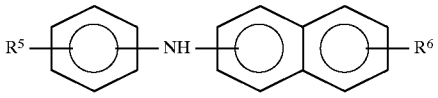

[2]

is used as the amine oxidant, the component (B).

In the above general formula [1], $R^1$, $R^2$, $R^3$ and $R^4$ each represent hydrogen atom or a hydrocarbon group having 1 to 18 carbon atoms. Further, although $R^1$, $R^2$, $R^3$ and $R^4$ each represent hydrogen atom or a hydrocarbon group having 1 to 18 carbon atoms. Further, although $R^1$, $R^2$, $R^3$ and $R^4$ may be the same or different from one another, it is necessary that at least one of them be an alkyl group having 3 to 18 carbon atoms. The alkyl group having 3 to 18 carbon atoms may be any of linear, branched and cyclic ones. Examples of such an alkyl group include propyl, butyl, amyl, hexyl, heptyl, octyl, nonyl, decyl, undecyl, dodecyl, tridecyl, tetradecyl, pentadecyl, hexadecyl, heptadecyl and octadecyl groups of all types, and cyclohexyl, cyclooctyl and cyclododecyl groups.

In the above general formula [2], $R^5$ and $R^6$ are hydrogen atom or a hydrocarbon group having 1 to 18 carbon atoms. A preferable hydrocarbon group is an alkyl group having 3 to 18 carbon atoms, which may be any of linear, branched and cycilic ones. Examples of such an alkyl group include the same groups as those enumerated in the explanation of $R^1$, $R^2$, $R^3$ and $R^4$ in the above general formula [1]. Specifically, the following compounds can be mentioned as the diarylamines: p,p'-dibutyl-diphenylamine, p,p'-dipentyldiphenylamine, p,p'-dihexyl-diphenylamine, p,p'-diheptyldiphenylamine, p,p'-dioctyl-diphenylamine, p,p'-dinonyldiphenylamine, monooctyldiphenyl-amine, monononyldiphenylamine, tetrabutyldiphenylamine, tetrahexyldiphenylamine, tetraoctyldiphenylaniine, tetranonyldiphenylamine, a mixture of alkyldiphenylamines having 4 to 9 carbon atoms, phenyl-α-naphthylamine, phenyl-β-naphthylamine, butylphenyl-α-naphthylamine, butylphenyl-β-naphthylamine, pentylphenyl-α-naphthylamine, pentylphenyl-β-naphthylamine, hexylphenyl-α-naphthylamine, hexylphenyl-β-naphthylamine, heptylphenyl-α-naphthylamine, heptylphenyl-β-naphthylamine, octylphenyl-α-naphthylamine, octylphenyl-β-naphthylamine, nonylphenyl-α-naphthylamine and nonylphenyl-β-naphthylamine. Particularly preferable diarylamines are p,p'-dioctyldiphenylamine, phenyl-α-naphthylamine and alkylphenyl-α-naphthylamines.

In the composition of the present invention, one or two or more of the alkyldiphenylamines represented by the above general formula [1], or one or two or more of the phenyl-α-naphthylamines represented by the above general formula [2] may be used as the amine oxidant, the component (B). Moreover, one or more of the alkyldiphenylamines represented by the general formula [1], and one or more of the phenyl-α-naphthylamines represented by the general formula [2] may also be used in combination as the amine oxidant.

In the present invention, it is necessary to incorporate the amine oxidant, the component (B), into the composition in an amount of 0.05 to 3% by weight, preferably 0.2 to 2% by weight of the total weight of the composition. When the amount of the amine oxidant is less than 0.05% by weight, the resulting composition cannot have sufficiently high oxidation stability. On the other hand, when the amount is in excess of 3% by weight, the effects of the oxidant expected from such an amount cannot be obtained.

In the composition of the present invention, at least one compound selected from oxymolybdenum sulfide dithiocarbamates (MoDTC) of the general formula [3]:

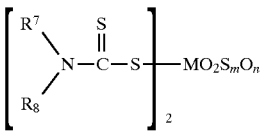

[3]

oxymolybdenum sulfide organophosphorodithioates (MoDTP) of the general formula [4]:

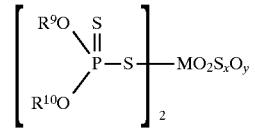

[4]

and oxymolybdenum sulfide dithioxanthogenates (MoDTX) of the general formula [5]:

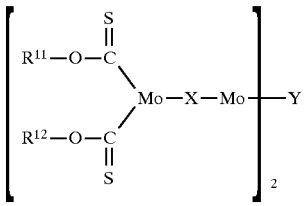

[5]

is used as the friction modifier; the component (C).

In the above general formula [3], $R^7$ and $R^8$ each represent a hydrocarbon group having 5 to 23 carbon atoms, and they may be the same or different from each other. Examples of the hydrocarbon group having 5 to 23 carbon atoms include a linear or branched alkyl or alkenyl group having 5 to 23 carbon atoms, and a cycloalkyl, aryl, alkylaryl or arylalkyl group having 6 to 23 carbon atoms. Preferable hydrocarbon groups are those having 8 to 23 carbon atoms. Specific examples of such hydrocarbon groups include 2-ethylhexyl, n-octyl, nonyl, decyl, lauryl, tridecyl, palmityl, stearyl, oleyl, eicosyl, butylphenyl and nonylphenyl groups. Further, m and n are a positive integer, provided that the total number of m and n is 4.

In the above general formula [4], $R^9$ and $R^{10}$ each represent a hydrocarbon group having 1 to 18 carbon atoms, and they may be the same or different from each other. Preferable hydrocarbon groups are those having 3 to 18 carbon atoms, most preferably 8 to 18 carbon atoms. Examples of the hydrocarbon groups having 3 to 18 carbon atoms include a linear or branched alkyl or alkenyl group having 3 to 18 carbon atoms, a cycloalkyl group having 6 to 18 carbon atoms, an aryl group having 6 to 18 carbon atoms, and an alkylaryl or arylalkyl group having 7 to 18 carbon atoms. Specific examples of such groups include isopropyl, n-propyl, n-butyl, isobutyl, sec-butyl, amyl, hexyl, cyclohexyl, 2-ethylhexyl, n-octyl, nonyl, decyl, lauryl, tridecyl, palmityl, stearyl, oleyl, butylpheyl and nonylphenyl groups. Further, x and y are a positive intetger, provided that the total number of x and y is 4.

In the above general formula [5], $R^{11}$ and $R^{12}$ each represent a hydrocarbon group having 1 to 30 carbon atoms, and they may be the same or different from each other. Preferable hydrocarbon groups are those having 3 to 20 carbon atoms, most preferably 8 to 18 carbon atoms. Examples of such hydrocarbon groups include a linear or branched alkyl or alkenyl group having 5 to 20 carbon atoms, a cycloalkyl group having 6 to 20 carbon atoms, and an aryl, alkylaryl or arylalkyl group having 6 to 20 carbon atoms. Specific examples of such groups include isopropyl, n-propyl, isobutyl, n-butyl, sec-butyl, amyl, hexyl, cyclohexyl, 2-ethylhexyl, n-octyl, nonyl, decyl, lauryl, tridecyl, palmityl, stearyl, oleyl, butylpheyl and nonylphenyl groups. Further, X and Y are oxygen or sulfur atom, and may be the same or different from each other.

In the composition of the present invention, the MoDTC represented by the above general formula [3] may be used either singly or in combination of two or more. The MoDTP represented by the general formula [4] may also be used either singly or in combination of two or more. Further, the MoDTX represented by the general formula [5] may also be used either singly or in combination of two or more.

In the composition of the present invention, it is necessary to incorporate the friction modifier, the component (C), into the composition in such an amount that the amount of molybdenum will be 50 to 2000 ppm by weight, preferably 100 to 1000 ppm by weight of the total weight of the composition. When the amount of molybdenum is less than 50 ppm by weight, lubricating properties cannot be sufficiently obtained. On the other hand, when the amount of molybdenum is in excess of 200 ppm by weight, lubricating properties expected from such an amount cannot be obtained.

Those additives which have been usually incorporated into the conventional lubricating oils, such as a metallic detergent, a nonash detergent-dispersant, an antiwear agent, a viscosity index improver, a pour point depressant, a rust preventive, a corrosion inhibitor, an anti-foaming agent and other antioxidants, can be added, if necessary, to the lubricating oil composition of the present invention within such a limit that the object of the present invention can be fully attained.

Examples of the metallic detergent include calcium sulfonate, magnesium sulfonate, barium sulfonate, calcium phenate, barium phenate, calcium salicylate and magnesium salicylate. In general, the metallic detergent is incorporated into the composition in an amount of 0.1 to 5% by weight. Examples of the nonash detergent-dispersant include those of succinimide type, succinimide type, benzylamine or its boron derivative type and ester type. In general, such a detergent is incorporated into the composition in an amount of 0.5 to 7% by weight.

Examples of the antiwear agent include metallic (Zn, Pb, Sb, Mo, etc.) salts of thiophosphoric acid, metallic (Zn, etc.) salts of thiocarbamic acid, sulfur compounds, phosphoric esters and phosphorous esters. In general, this agent is incorporated into the composition in an amount of 0.05 to 5.0% by weight.

Examples of the viscosity index improver include those of polymethacrylate type, polyisobutylene type, ethylene-propylene copolymer type and styrene-butadiene hydrogenated copolymer type. In general, such an improver is incorporated into the composition in an amount of 0.5 to 35% by weight.

Examples of the rust preventive include alkenyl succinates and partial esters thereof. Examples of the corrosion inhibitor include benzotriazole and benzoimidazole. Examples of the anti-foaming agent include dimethyl polysiloxane and polyacrylate. These agents may be incorporated into the composition, when necessary.

EXAMPLES

The present invention will now be explained more specifically by referring to the following Examples. However, the present invention is not limited by these examples in any way.

The oxidation-induction time and coefficient of friction of the lubricating oil compositions were obtained in the following respective manners.

(1) Coefficient of Friction ($\mu$)

LFW-1 friction test was carried out by using an LFW-1 tester shown in FIG. 1 equipped with an R-type block (made of iron) manufactured by Falex Corporation and an S-10 test ring (made of iron) manufactured by Falex Corporation under the following conditions: the number of revolutions was 270 rpm, the load was 30 kgf, the temperature of the oil was 120° C., and the time was 10 minutes. In FIG. 1, reference numeral 1 indicates the S-10 test ring, reference numeral 2 indicates the R-type block and reference numeral 3 indicates a distortion meter. Load is applied to the R-type block, and the resistance caused by the rotation of the ring is measured by the distortion meter. The coefficient of friction is calculated from the resistance measured. It is noted that approximately half of the ring is immersed in the oil to be tested.

(2) Oxidation-Induction Time (minutes)

The oxidation-induction time was determined by means of differential thermal analysis which was conducted under oxygen atmosphere, by applying a load of 20 kgf/cm$^2$ and heating the sample to 200° C.

EXAMPLES 1 TO 8 AND COMPARATIVE EXAMPLES 1 TO 7

By the use of a base oil shown in Table 1, a lubricating oil composition having a formulation shown in Table 2 was prepared. The coefficient of friction ($\mu$) and oxidation-induction time (minutes) of the composition were obtained. The results are shown in Table 2.

TABLE 1

| BASE OIL | VISCOSITY AT 100° C. (mm$^2$/s) | AROMATIC CONTENT (wt %) | MONOCYCLIC NAPHTHENE CONTENT (wt %) | SULFUR CONTENT (wt. ppm) | NITROGEN CONTENT (wt. ppm) |
|---|---|---|---|---|---|
| 70N | 3.1 | 1.1 | 32 | 1.0 | 0.3 |
| 150N-1 | 5.5 | 0.5 | 30 | 0.5 | 0.1 |
| 350N | 9 | 1.3 | 32 | 0.7 | 0.1 |
| 150N-2 | 5.6 | 7.0 | 18 | 13.0 | 7.0 |
| 150N-3 | 5.4 | 2.0 | 24 | 137.0 | 71.0 |
| 150N-4 | 5.7 | 4.1 | 19 | 11.0 | 89.0 |

TABLE 2

| | Example 1 | Example 2 | Example 3 | Example 4 | Example 5 | Example 6 | Example 7 | Example 8 |
|---|---|---|---|---|---|---|---|---|
| Formulation Chemical Composition (wt %) | | | | | | | | |
| Base Oil | | | | | | | | |
| 70N | balance | — | — | — | — | — | — | — |
| 150N-1 | — | balance | — | balance | balance | balance | balance | balance |
| 350N | — | — | balance | — | — | — | — | — |
| 150N-2 | — | — | — | — | — | — | — | — |
| 150N-3 | — | — | — | — | — | — | — | — |
| 150N-4 | — | — | — | — | — | — | — | — |

TABLE 2-continued

| | Example 1 | Example 2 | Example 3 | Example 4 | Example 5 | Example 6 | Example 7 | Example 8 |
|---|---|---|---|---|---|---|---|---|
| alkyl($C_{4-8}$)diphenylamine | 0.5 | 0.5 | 0.5 | 1.5 | — | — | 0.5 | 0.5 |
| alkylated($C_8$)phenyl-α-naphthylamine | — | — | — | — | 0.3 | 1.2 | — | — |
| 4,4'-methylenebis(2,6-ti-t-butylphenol) | — | — | — | — | — | — | — | — |
| MoDTC ($C_{13}$) | 1.0 | 1.0 | 1.0 | 1.0 | 1.0 | 1.0 | — | — |
| MoDTP ($C_6$) | — | — | — | — | — | — | 0.6 | — |
| MoDTX ($C_{18}$) | — | — | — | — | — | — | — | 0.4 |
| Evaluation | | | | | | | | |
| coefficient of friction (μ) | 0.035 | 0.039 | 0.042 | 0.041 | 0.040 | 0.037 | 0.045 | 0.041 |
| oxidation induction period (minutes) | 24.3 | 25.6 | 29.3 | 33.6 | 26.6 | 36.1 | 25.9 | 26.5 |

TABLE 3

| | (COMPARATIVE EXAMPLES) | | | | | | |
|---|---|---|---|---|---|---|---|
| | Comp. Example 1 | Comp. Example 2 | Comp. Example 3 | Comp. Example 4 | Comp. Example 5 | Comp. Example 6 | Comp. Example 7 |
| Formulation Chemical Composition (wt %) | | | | | | | |
| Base Oil | | | | | | | |
| 70N | — | — | — | — | — | — | — |
| 150N-1 | — | — | — | — | — | — | — |
| 350N | — | — | — | — | balance | — | — |
| 150N-2 | balance | — | — | balance | — | — | balance |
| 150N-3 | — | balance | — | — | — | — | — |
| 150N-4 | — | — | balance | — | — | balance | — |
| alkyl($C_{4-8}$)diphenylamine | 0.5 | 0.5 | — | 0.5 | — | — | 0.5 |
| alkylated($C_8$)phenyl-α-naphthylamine | — | — | 1.2 | — | — | — | — |
| 4,4'-methylenebis(2,6-ti-t-butylphenol) | — | — | — | — | 0.5 | 0.5 | — |
| MoDTC ($C_{13}$) | 1.0 | 1.0 | 1.0 | — | 1.0 | 1.0 | — |
| MoDTP ($C_6$) | — | — | — | 0.6 | — | — | — |
| MoDTX ($C_{18}$) | — | — | — | — | — | — | 0.4 |
| Evaluation | | | | | | | |
| coefficient of friction (μ) | 0.035 | 0.049 | 0.051 | 0.053 | 0.050 | 0.056 | 0.059 |
| oxidation induction period (minutes) | 15.2 | 14.3 | 21.8 | 13.9 | 21.3 | 16.4 | 15.5 |

All of the lubricating oils of Examples 1 to 8, which are the compositions of the present invention, have a low coefficient of friction and a long oxidation-induction time. In contrast, the lubricating oil of Comparative Example 1 has a low coefficient of fiction but has a short oxidation-induction time. The lubricating oils of Comparative Examples 2 to 7 are remarkably inferior to those of Examples of the present invention in both the coefficient of friction and the oxidation-induction time.

The lubricating oil compositions of the present invention have high heat resistance, high oxidation stability and excellent lubricating properties, and are particularly useful for lubricating oils for internal-combustion engines and the like.

We claim:

1. A lubricating oil composition comprising:

(A) a lubricating base oil containing 3% by weight or less of aromatics, 20% by weight or more of monocyclic naphthenes, 50 ppm by weight or less of sulfur and 50 ppm by weight or less of nitrogen, having a viscosity of 2 to 50 $mm^2/s$ at 100° C.;

(B) at least one compound selected from diarylamines of the general formula:

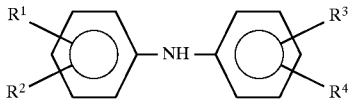

(1)

wherein $R^1$, $R^2$, $R^3$, and $R^4$, which may be the same or different, each represent hydrogen atom or a hydrocarbon group having 1 to 18 carbon atoms, provided that at least one of them is a hydrocarbon group having 3 to 18 carbon atoms, or

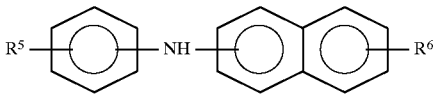

(2)

wherein $R^5$ and $R^6$ are hydrogen atom or a hydrocarbon group having 1 to 18 carbon atoms, in an amount of 0.05 to 3% by weight of the total weight of the composition, and (C) at least one oxymolybdenum compound selected from oxymolybdenum sulfide dithioxanthogenates of the general formula:

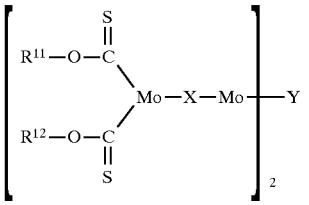

(5)

wherein $R^{11}$ and $R^{12}$, which may be the same or different, each represent a hydrocarbon group having 1 to 30 carbon atoms, and X and Y, which may be the same or different, each represent oxygen or sulfur atom, in such an amount that the amount of molybdenum is 50 to 2000 ppm by weight of the total weight of the composition.

2. The lubricating oil composition of claim 1 wherein the base oil is a hydrogenated oil containing 3% by weight or less of aromatics, 20% by weight of more of monocyclic naphthenes and 97% by weight or more of saturated compounds.

3. The lubricating oil composition of claim 1 or 2 wherein $R^{11}$ and $R^{12}$ each represent a hydrocarbon group having 8 to 18 carbon atoms.

* * * * *